US006400266B1

(12) United States Patent
Brown, Jr.

(10) Patent No.: US 6,400,266 B1
(45) Date of Patent: Jun. 4, 2002

(54) DOOR SENSOR FOR A TRAILER

(75) Inventor: James B. Brown, Jr., Lafayette, IN (US)

(73) Assignee: Wabash Technology Corporation, Arlington Heights, IL (US)

( * ) Notice: Subject to any disclaimer, the term of this patent is extended or adjusted under 35 U.S.C. 154(b) by 0 days.

(21) Appl. No.: 09/557,030

(22) Filed: Apr. 20, 2000

(51) Int. Cl.[7] ..... E05B 45/06

(52) U.S. Cl. ..... 340/542; 340/431; 340/547; 70/432; 307/10.2; 180/287

(58) Field of Search ..... 340/542, 545.1, 340/547, 540, 431, 545.6; 307/10.2, 10.8, 9.1; 70/432, 434, 262, 263, 264; 180/287

(56) References Cited

U.S. PATENT DOCUMENTS

| | | | | |
|---|---|---|---|---|
| 3,653,686 A | | 4/1972 | Roesies | |
| 3,924,256 A | * | 12/1975 | Cohen | 340/542 |
| 4,271,401 A | | 6/1981 | Meo | |
| 4,430,637 A | | 2/1984 | Koch-Dücker et al. | |
| 4,438,430 A | * | 3/1984 | Young | 340/547 |
| 4,750,197 A | * | 6/1988 | Denekamp | 340/825.35 |
| 4,816,803 A | * | 3/1989 | Brown | 340/426 |
| 4,866,963 A | * | 9/1989 | Leininger | 70/278 |
| 5,025,253 A | | 6/1991 | DiLullo et al. | |
| 5,168,258 A | * | 12/1992 | Radke | 340/542 |
| 5,277,285 A | | 1/1994 | Musachio | |
| 5,602,526 A | * | 2/1997 | Read | 340/457 |
| 5,630,603 A | | 5/1997 | Turner et al. | |
| 5,685,578 A | * | 11/1997 | Schneider | 292/144 |
| 5,912,616 A | | 6/1999 | Valentino | |
| 5,975,713 A | * | 11/1999 | Brothers | 362/155 |

* cited by examiner

*Primary Examiner*—Anh La
(74) *Attorney, Agent, or Firm*—Trexler, Bushnell, Giangiorgi, Blackstone & Marr, LTD

(57) ABSTRACT

A system is provided for sensing the presence of a standard component of a locking mechanism of a door of a trailer when the door is moved to the closed position and is secured. A sensor is provided on the trailer proximate to the locking mechanism. The sensor automatically reacts when a ferrous target comes within its sensing range. Control circuitry on the trailer processes and uses signals from the sensor to perform various functions.

14 Claims, 5 Drawing Sheets

DOOR SENSOR FOR A TRAILER

BACKGROUND OF THE INVENTION

This invention is generally directed to a novel system that determines whether the trailer door is open or closed. This information can be relayed to a trailer tracking system or to the semi-tractor so that this information can be used accordingly.

Some prior art systems sense the presence of a door using a mechanical limit switch. As the door closes, the arm of the mechanical limit switch is moved to indicate that the door is closed. This type of system is believed to have been used by Trucklite, a New York based automotive lighting and electronics company.

Other prior art systems use magnetic based switch technology to sense the status of the door. A magnetic target is mounted to the door and a reed switch is located on the sidewall where the door swings back to when fully opened. When the door is opened, the magnetic target comes into sensing range of the reed switch. The reed switch senses the magnetic target to indicate that the door is open. This type of system is believed to have been used by Vehicle Enhancement Systems (VES) and Vantage Tracking Solutions.

Another prior art system, used in 1996, used a magnet biased reed switch, mounted in the corner of the door frame that would sense the inside, steel skin of the door when the door was closed. Yet another prior art system, used in 1999, used a magnet biased reed switch in conjunction with a steel target plate to sense the position of the door. The reed switch was mounted to the door so that when the door was closed, the target plate would be in range of the reed switch and the door would be sensed as closed. These systems were developed and have been used by the assignee of the present invention.

In the prior systems in which a secondary component apart from the sensor is needed, more parts are provided which need to be inventoried and maintained. In addition, the sensor can be installed and working, but the secondary component (for example, the target plate or the magnet target) could be removed (either through accident or on purpose) and not replaced. If this occurs, because the secondary component is missing and in the situation where the door is closed, the prior art sensing system would sense that the door is open. In the prior art system in which the sensor was mounted in the corner of the door frame and sensed the inside, steel skin of the door when the door was closed, the sensor can be knocked off when materials are being loaded into the trailer.

The present invention provides a novel system for sensing whether a door of a trailer is open or is closed which uses a sensor and a standard component of the locking mechanism on the door of the trailer. The present invention does not require a secondary component to sense the door. This enables the system to be easier to install and easier to maintain than prior art systems. In addition, in the preferred embodiment of the system of the present invention, the status of the sensor can be monitored more readily than in the prior art systems. Because the secondary component is eliminated in the present invention, the situation where the door is closed, but the secondary component is missing so that the sensor senses that the door is open is eliminated. Other features and advantages of the present invention will become apparent upon a reading of the attached specification in combination with a study of the drawings.

OBJECTS AND SUMMARY OF THE INVENTION

A general object of the present invention is to provide a novel system for sensing whether a door of a trailer is open or is closed.

Another object of the present invention is to provide a novel system for sensing whether a door of a trailer is open or is closed by using a standard component of the locking mechanism of the trailer door.

Yet another object of the present invention is to provide a novel system in which the status of the sensor can be determined.

A further object of the present invention is to provide a novel system which is easy to install and maintain.

The present invention discloses a novel system for sensing whether a door of a trailer is open or is closed. A sensor is provided on the rear door frame proximate to the lockrod keeper of a conventional locking mechanism. The sensor senses the presence of the heel portion of the lockrod cam when the lockrod is engaged with the lockrod keeper. Control circuitry on the trailer processes and uses signals from the sensor to perform various functions.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
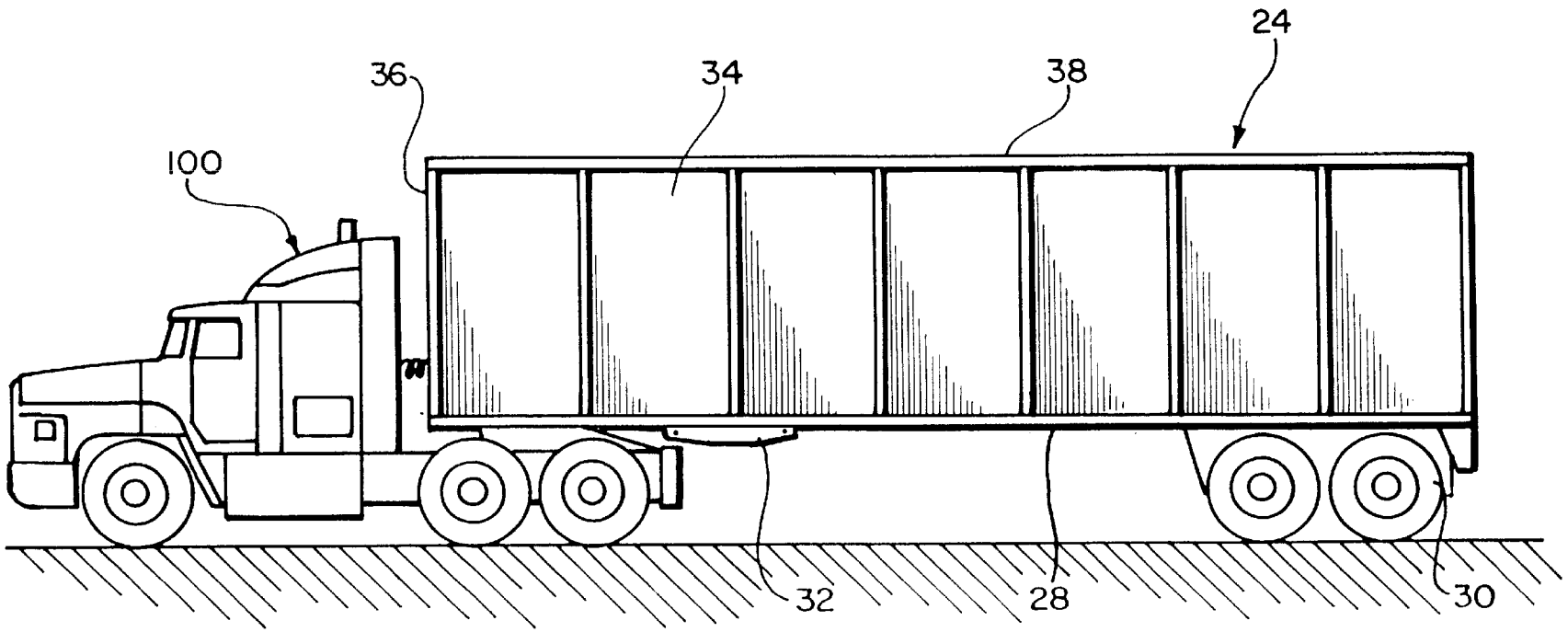
FIG. 1 is a side elevational view of a trailer connected to a semi-tractor.
Figure 2:
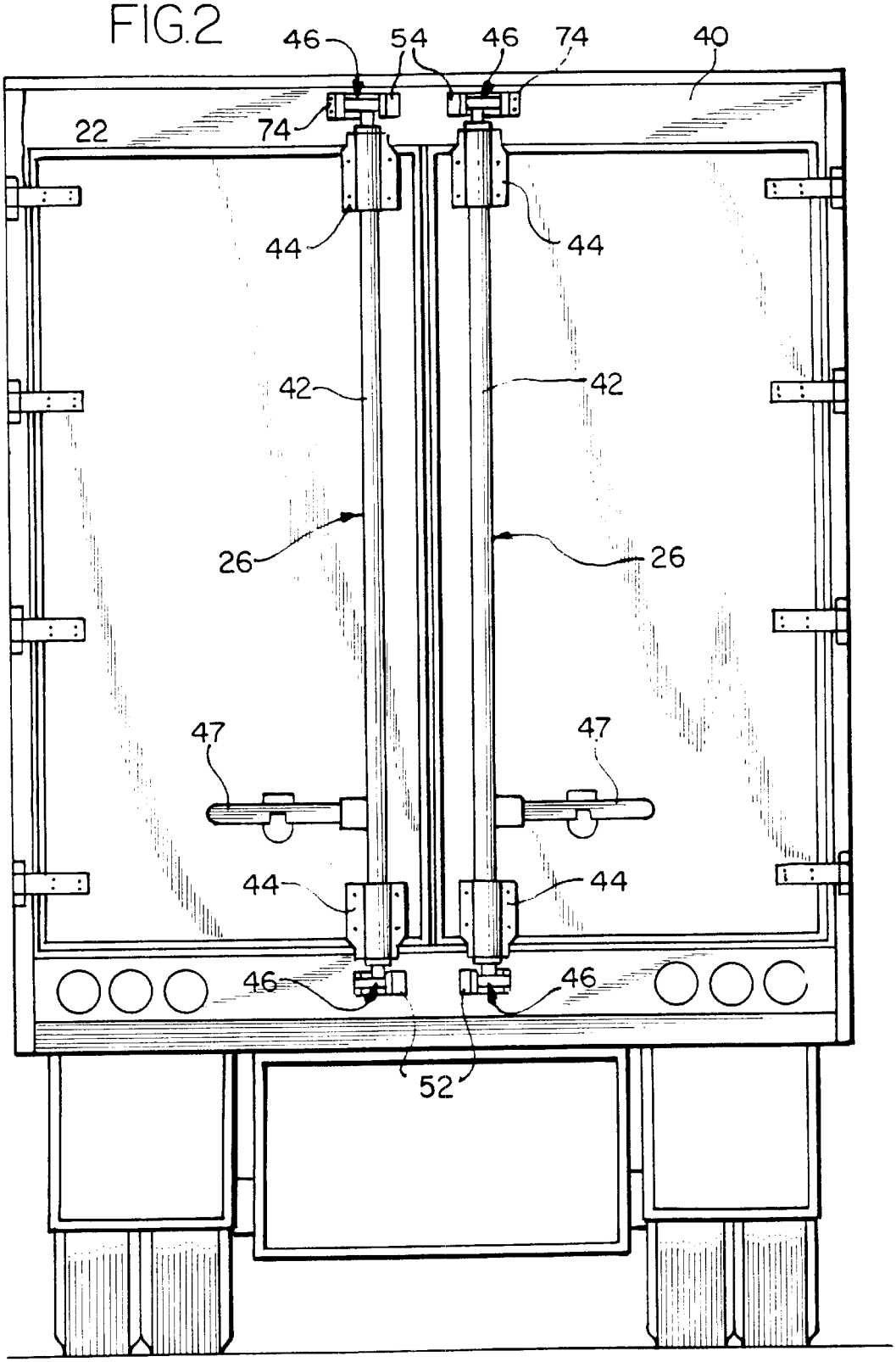
FIG. 2 is a rear elevational view of the trailer as shown in FIG. 1.
Figure 3:
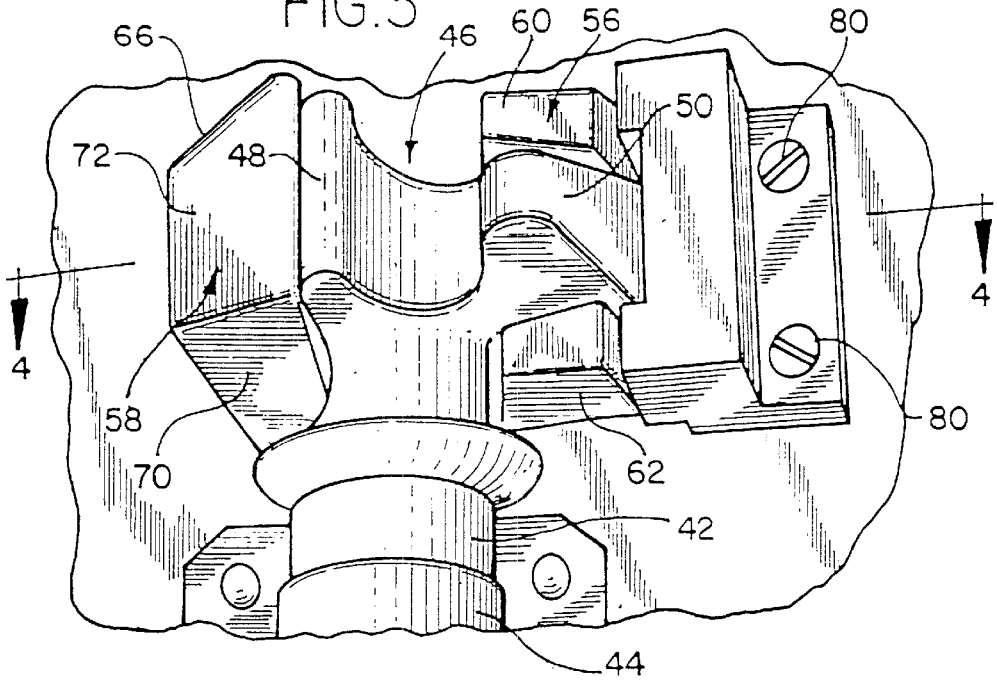
FIG. 3 is an enlarged perspective view of a portion of the locking mechanism portion of the trailer which incorporates the features of the invention.
Figure 4:
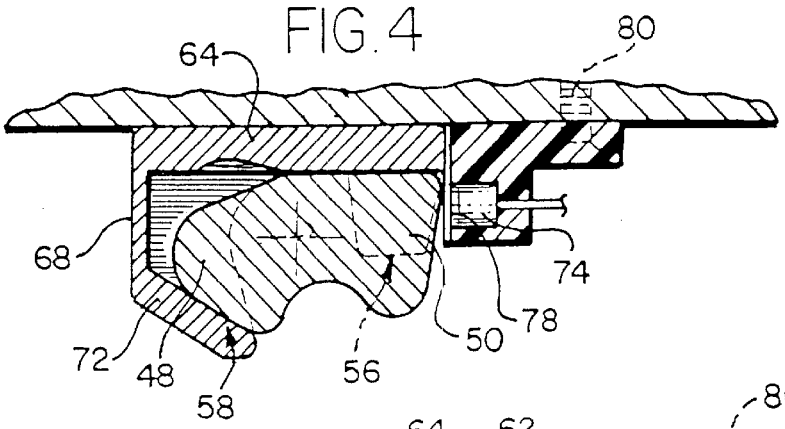
FIG. 4 is a cross-sectional view along line 4—4 of FIG. 3.
Figure 5:
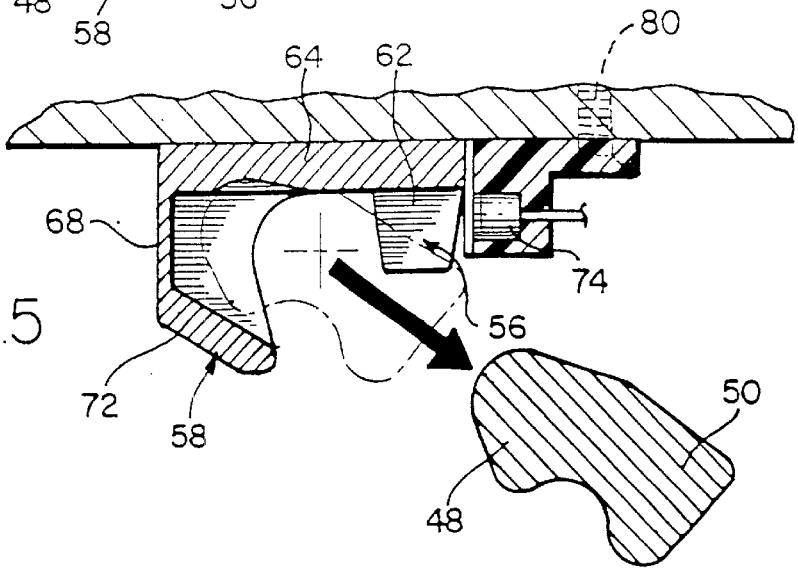
FIG. 5 is a cross-sectional view similar to FIG. 4, showing a moveable portion of the locking mechanism being released from a stationary portion of the locking mechanism.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

The present invention provides a novel system 20 that determines whether the door 22 of a trailer 24 is open or closed. As such, the system 20 can determine if the trailer 24 is being unloaded (doors 22 open) or secure (doors 22 closed). In particular, the system 20 senses the presence of a component of the locking mechanism 26 which is used to secure each door 22 in the closed position. The system 20 of the present invention can be used to track the location of the trailer 24 when used with a trailer tracking system, so that the owner of the trailer 24 is able to locate the trailer 24 and to determine whether the trailer 24 is being unloaded or secure.

The trailer 24 used in the present invention is conventional. The trailer 24 includes a floor 28 with an undercarriage assembly 30 thereunder at its rearward end and an extendable and retractable landing gear assembly 32 thereunder positioned approximately half way between the front end of the trailer 24 and the trailer's longitudinal center of gravity. Opposite side walls 34 and a front wall 36 extend upwardly from the floor 28. A roof 38 is provided to close the top of the trailer 24. A pair of rear doors 22 are provided at the rear end of the trailer 24 and are hingedly mounted to a rear frame 40 which has a rectangular opening therethrough into which the rear doors 22 fit when the rear doors 22 are moved to the closed position.

Each rear door 22 has a locking mechanism 26 thereon which is conventional. Each locking mechanism 26 is identical and as such, only one of locking mechanisms 26 is described.

The locking mechanism 26 includes an elongated, cylindrical lockrod 42 which extends along the height of the rear door 22. A generally U-shaped bearing plate 44 is provided at each end of the lockrod 42 and is secured to the rear door 22 by fasteners. The lockrod 42 rotates within the bearing plates 44. A handle 47 is provided for manipulating the position of the lockrod 42.

A cam 46, which is formed of a ferrous material, is integrally formed at each of the lockrod 42. Each cam 46 includes a toe portion 48 and a heel portion 50. The toe portion 48 extends generally perpendicular to the lockrod 42 on one side thereof and the heel 50 portion extends generally perpendicular to the lockrod 42 on the other side thereof.

A lower door lockrod keeper 52, which is formed of a ferrous material, is mounted on the rear frame 40 below the door opening, and an upper door lockrod keeper 54, which is formed of ferrous material, is mounted on the rear frame 40 above the door opening. Each keeper 52, 54 includes a U-shaped portion 56 and a cup-like portion 58 which are integrally formed with each other and which are spaced apart from each other. The U-shaped portion 56 includes first and second legs 60, 62 which are spaced apart from each other and which extend from a base plate 64. The cup-like portion 58 includes first, second and third side walls 66, 68, 70 which extend from the base plate 64, and an outer wall 72 which is connected to the outer ends of each of the side walls 66, 68, 70. The first and third side walls 66, 70 are spaced apart from and parallel to each other. Each keeper 52, 54 is attached to the rear frame 40 by suitable means, such as a weldment.

The present invention provides a sensor 74 which is mounted on the rear frame 40, and which is configured to sense the presence of the heel portion 50 of the cam 46 when the mechanical connection is made between the cam 46 and the keeper 54. The sensor 74 is mounted within a plastic housing 76 that is mounted to the rear frame 40 proximate to the U-shaped portion 56 of the upper keeper 54. The face 78 of the sensor 74 is proximate to the space between the legs 60, 62 of the U-shaped portion 56. The sensor 74 can be mounted to the rear frame 40 above or below the door opening. As shown, the sensor 74 is mounted to the rear frame 40 above the door opening. The housing 76 is mounted to the rear frame 40 by suitable means, such as bolts 80 which extend through the rear frame 40 with nuts (not shown) on the backside of the rear frame 40. Many different types of sensors 74 can be used, such as a proximity sensor, an electrical contact type sensor, a fiber optic sensor, a photo optic sensor, a magnetic sensor, a capacitance sensor, a Hall Effect sensor, a mechanical sensor, a photo eye sensor, a laser sensor, and the like.

Figure 7:
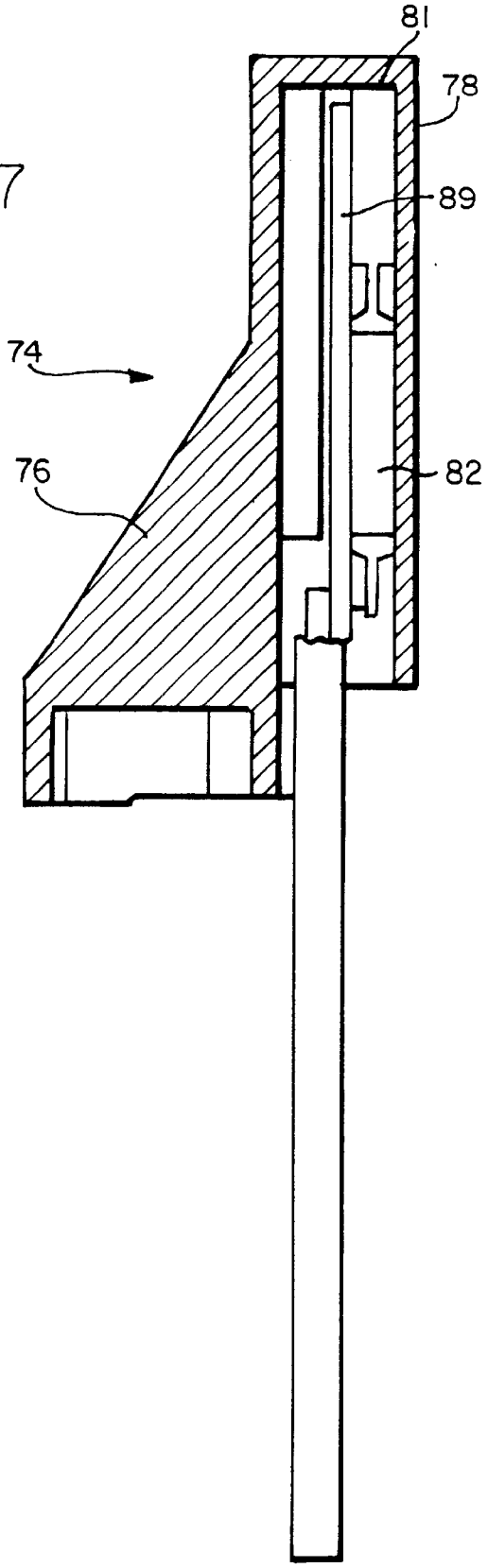
FIG. 7 is a cross-sectional view of the preferred sensor which is a component in the present invention.
Figure 6:
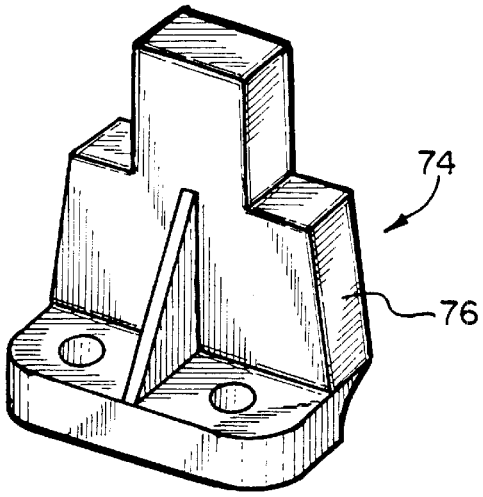
FIG. 6 is a perspective view of a preferred sensor which is a component in the present invention.
Figure 8:
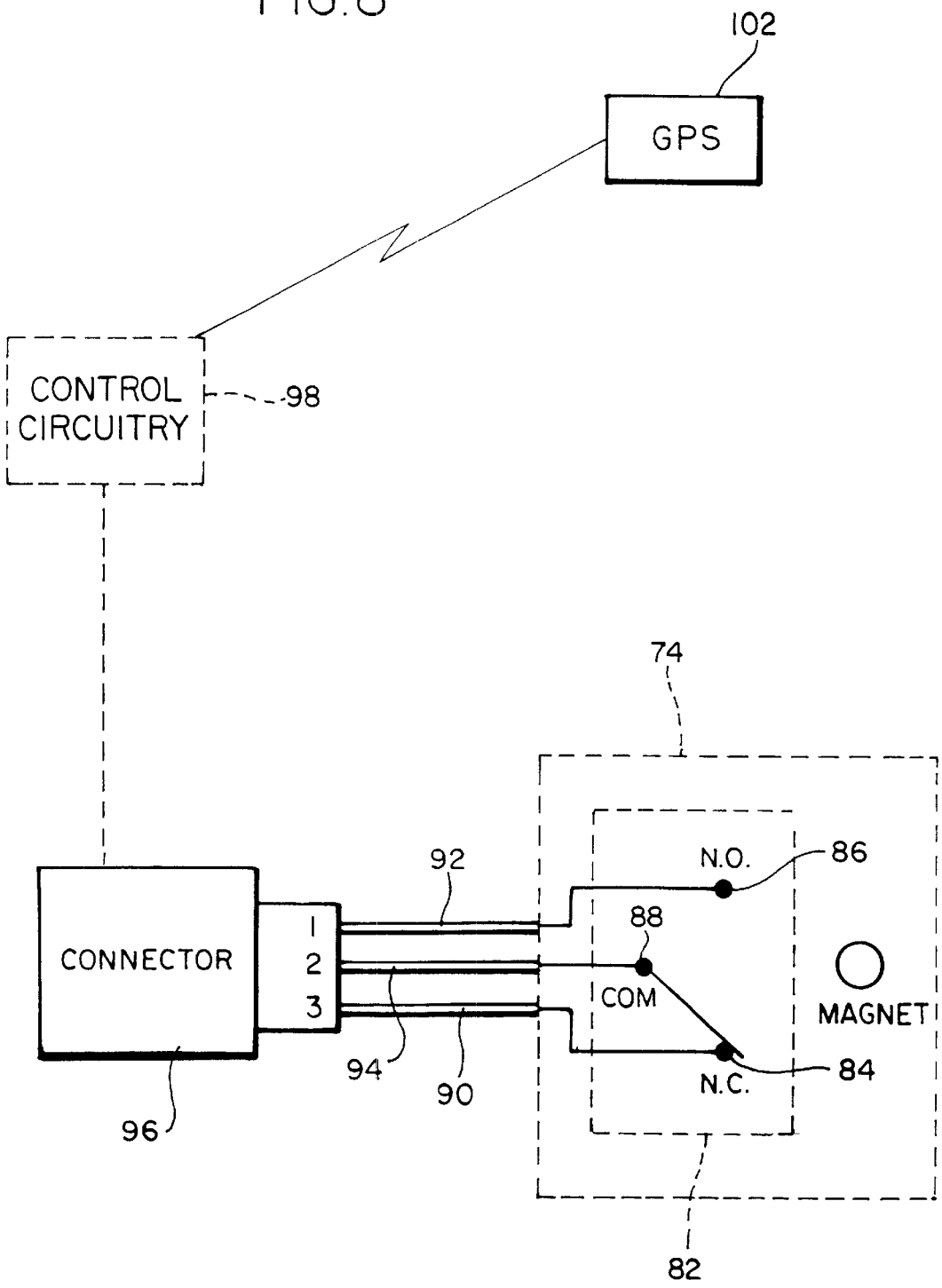
FIG. 8 is an electrical diagram of the preferred sensor.

The preferred sensor 74 used in the present invention, as shown in FIGS. 6 and 7, is a Ferrous Proximity sensor comprised of a Magnet Biased Reed Switch that utilizes a Form C switch for sensing ferrous metal within the sensing range, and which is shown in FIGS. 6–8. The Ferrous Proximity sensor 74 is comprised of a sensing circuit 81 and a Magnet Biased Reed Switch 82 which includes a normally closed terminal 84, a normally open terminal 86 and a common terminal 88 (a Form C switch). The normally closed terminal 84, the normally open terminal 86 and the common terminal 88 are mounted to a printed circuit board 89 and located inside the plastic housing 76. The normally closed terminal 84, the normally open terminal 86, the common terminal 88 and the printed circuit board 89 are potted with an epoxy material that protects the internal components of sensor 74. Wire leads 90, 92, 94 which are roughly six inches long and respectively are connected to the normally closed terminal 84, the normally open terminal 86, and the common terminal 88, are soldered to the printed circuit board 89 and exit the plastic housing 76. The wire leads 90, 92, 94 terminate with a connector 96. The connector 96 connects the sensor 74 to control circuitry 98 through harnesses (harnesses not shown). The control circuitry 98 may be the electronic control unit provided on the trailer 24 which forms part of the trailer tracking system. It is envisioned that the control circuitry 98 be the electronic control unit of an antilock brake system on the trailer 24 or an other system on the trailer 24.

When the lockrod 42 interfaces with the keepers 52, 54, each toe portion 48 of the cam 46 is inserted into the respective cup-shaped portions 58. The lockrod 42 is rotated until each heel portion 50 is seated between the legs 60, 62 of the respective U-shaped portions 56. As such, the heel portion 50 comes within the sensing range of the sensor 74 and the sensor 74 automatically reacts. When the heel portion 50 is detected by the sensor 74 (i.e., when the doors of the trailer 24 is closed), the normally open terminal 86 comes into electrical contact with the common terminal 88. That is, when the sensor 74 senses the ferrous target (the heel portion 50) within its sensing range, the sensor 74 causes the reed switch 82 to change state, such that the common terminal 88 and the normally open terminal 86 complete an electrical circuit.

When the heel portion 50 is not detected by the sensor 74 (i.e., when the doors 22 of the trailer 24 are open and no ferrous target is sensed by the sensor 74 within its sensing range), the normally closed terminal 84 is in electrical contact with the common terminal 88. The common terminal 88 and the normally open terminal 86 are unmated.

The use of the common terminal 88 and the normally closed terminal 84 provides a feedback circuit to the control circuitry 98. That is, when there is not a ferrous target within range of the sensor 74, the common terminal 88 and the normally closed terminal 84 are mated, thus changing the state of the reed switch 82. This circuit path, utilizing the common terminal 88 and the normally closed terminal 84, provides information to the control circuitry 98. The control circuitry 98 determines that there is not a ferrous target within the sensing range and the control circuitry 98 also determines that the sensor 74 is present and functional (for example, the sensor 74 has not be sheared off of the trailer 24). This is often referred to as a "heartbeat feedback" in that the sensor 74 provides feedback to the control circuitry 98 such that the control circuitry 98 determines that the sensor 74 is functional or "alive".

Accordingly, use of the Form C reed switch 82 provides a circuit path in both a condition where the doors 22 are open and the doors 22 are closed. If a Form A switch were used, only a common terminal and a normally open terminal would be provided (no normally closed terminal is provided), and the control circuitry would only be able to determine that the ferrous target is within the sensing range.

Each of these conditions (where the doors 22 are open or the doors 22 are closed) sends an electrical signal to the control circuitry 98 on the trailer 24. The control circuitry 98 can send information to a global positioning satellite (GPS) system 102 which forms part of the trailer tracking system. This allows the owner of the trailer 24 to know the location of the trailer 24, whether the doors 22 are open or closed, and if the sensor 74 is functional.

When the electrical signal indicates that the heel portion 50 is not detected, the control circuitry 98 on the trailer 24 can also be used to activate feed relay(s) or an electronic module on the trailer 24 to allow various functions of the trailer 24 to be performed, such as allowing the lift gate to be operable. This would prevent an unauthorized user from activating the function.

The electrical signal can also be sent to the semitractor 100 through the electrical connection between the semi-tractor 100 and the trailer 24 which interacts with a control circuit on the semi-tractor 100. This signal can be used to indicate to the operator that the doors 22 of the trailer 24 are open or closed. Also, the electrical signal sent to the control circuit on the semi-tractor 100 can be used to activate feed relay(s) or an electronic module on the trailer 24 to allow various functions of the trailer 24 to be performed by the operator, such as allowing the lift gate to be operable.

While a preferred embodiment of the present invention is shown and described, it is envisioned that those skilled in the art may devise various modifications of the present invention without departing from the spirit and scope of the appended claims.

The invention claimed is:

1. A system comprising:

a trailer, said trailer having a door and a locking mechanism for securing said door when said door is in a closed position, said locking mechanism having a plurality of components; and sensing means for sensing the presence of one of said components of said locking mechanism when said trailer door is in the secured and closed position.

2. A system as defined in claim 1, wherein said sensing means comprises at least one of a proximity sensor, a capacitance sensor, a Hall Effect sensor, a mechanical sensor, a photo eye sensor, and a laser sensor.

3. A system as defined in claim 1, wherein said sensing means comprises a Ferrous Proximity sensor comprised of a Magnet Biased Reed Switch that utilizes a Form C switch.

4. A system as defined in claim 1, wherein said sensing means comprises control circuitry configured to detect whether a sensor is connected to said control circuitry.

5. A system comprising:

a trailer, said trailer having a door and a locking mechanism for securing said door when said door is in a closed position, said locking mechanism including a lockrod which extends along the length of said door and has opposite ends, a cam provided on at least one end of said lockrod, and a keeper mounted on said trailer, said cam being releasably engageable with said keeper such that when said cam is engaged with said keeper, said door is secured; and sensing means for sensing the presence of said cam when said cam is engaged with said keeper when said trailer door is in the secured and closed position.

6. A system as defined in claim 5, wherein said sensing means is mounted proximate to said keeper on said trailer.

7. A system as defined in claim 6, wherein said sensing means is further mounted above said door.

8. A system as defined in claim 6, wherein said sensing means is further mounted below said door.

9. A method comprising the steps of:

providing a trailer having a door and a locking mechanism for securing said door when said door is in a closed position, said locking mechanism having a plurality of components, and control circuitry provided on said trailer;

providing sensing means for sensing the presence of one of said components of said locking mechanism;

using said sensing means to sense whether one of said components of said locking mechanism is within a sensing range of said sensing means and sending a signal to said control circuitry; and said control circuitry determining whether said door is closed and secured or open and unsecured.

10. A method as defined in claim 9, wherein said sensing means comprises at least one of a proximity sensor, a capacitance sensor, a Hall Effect sensor, a mechanical sensor, a photo eye sensor, and a laser sensor.

11. A method as defined in claim 9, wherein said sensing means comprises a Ferrous Proximity sensor comprised of a Magnet Biased Reed Switch that utilizes a Form C switch.

12. A method as defined in claim 11, wherein said sensing means includes a common terminal, a normally closed terminal and a normally open terminal, such that when said component of said locking mechanism is within the sensing range of said sensing means, said normally open terminal comes into electrical contact with the common terminal and a signal is sent to said control circuitry.

13. A method as defined in claim 12, wherein in response to said signal from said sensing means, said control circuitry sends a signal to a trailer tracking system.

14. A method as defined in claim 12, wherein in response to said signal from said sensing means, said control circuitry sends a signal to activate components on said trailer to allow various functions of the trailer to be performed.

* * * * *